US010872555B2

(12) United States Patent
Shikata

(10) Patent No.: US 10,872,555 B2
(45) Date of Patent: Dec. 22, 2020

(54) DISPLAY DRIVE CIRCUIT

(71) Applicant: Synaptics Japan GK, Tokyo (JP)

(72) Inventor: Atsushi Shikata, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 611 days.

(21) Appl. No.: 14/918,499

(22) Filed: Oct. 20, 2015

(65) Prior Publication Data

US 2016/0117978 A1 Apr. 28, 2016

(30) Foreign Application Priority Data

Oct. 27, 2014 (JP) ..... 2014-218209

(51) Int. Cl.
*G09G 3/16* (2006.01)
*G09G 3/20* (2006.01)

(52) U.S. Cl.
CPC ..... *G09G 3/2096* (2013.01); *G09G 2310/08* (2013.01); *G09G 2320/0247* (2013.01); *G09G 2320/064* (2013.01); *G09G 2320/0626* (2013.01); *G09G 2320/0646* (2013.01); *G09G 2330/022* (2013.01)

(58) Field of Classification Search
CPC ..... G09G 2320/0626; G09G 3/34; G09G 3/3406; G09G 3/3413; G09G 3/342; G09G 3/36
See application file for complete search history.

(56) References Cited

U.S. PATENT DOCUMENTS

2008/0136844 A1* 6/2008 Takada ..... G09G 3/3406 345/690
2009/0059078 A1* 3/2009 Kim ..... G09G 3/3406 348/645
2009/0251400 A1* 10/2009 Liu ..... G09G 3/3426 345/102
2010/0253611 A1* 10/2010 Takagi ..... G09G 3/3611 345/98

(Continued)

FOREIGN PATENT DOCUMENTS

JP 2008139842 A 6/2008
JP 2008152022 A 7/2008

(Continued)

*Primary Examiner* — William Boddie
*Assistant Examiner* — Jeffrey Parker
(74) *Attorney, Agent, or Firm* — Patterson + Sheridan, LLP

(57) ABSTRACT

A circuit apparatus is provided for driving source electrodes of a display panel based on image data and to control a backlight of the display panel. For example, the circuit apparatus includes a display drive (DD) circuit having a parameter generation (PG) part and an image data conversion (IDC) part. The PG part is operable to generate an image data-conversion parameter and a backlight control parameter based on a brightness distribution of the image data of one frame. The IDC part is operable to convert the image data based on the image data-conversion parameter. The DD circuit is operable to output source signals generated based on the converted image data and output, control the backlight based on the backlight control parameter, and stop an action of the parameter generation part in response to no change in the image data of one frame from image data of a preceding frame being detected.

19 Claims, 6 Drawing Sheets

(56) References Cited

U.S. PATENT DOCUMENTS

| | | | | |
|---|---|---|---|---|
| 2011/0025592 | A1* | 2/2011 | Botzas | G09G 3/3406 345/102 |
| 2013/0235014 | A1 | 9/2013 | Lee et al. | |
| 2013/0335309 | A1* | 12/2013 | Kerofsky | G09G 3/3406 345/102 |
| 2016/0260417 | A1* | 9/2016 | Asai | G09G 5/397 |

FOREIGN PATENT DOCUMENTS

| | | | |
|---|---|---|---|
| JP | 2008209828 | A | 9/2008 |
| JP | 2009098617 | A | 5/2009 |
| JP | 2013101354 | A | 5/2013 |
| JP | 2013190777 | A | 9/2013 |
| WO | WO-2013035594 | A1 | 3/2013 |

* cited by examiner

DISPLAY DRIVE CIRCUIT

CROSS-REFERENCE TO RELATED APPLICATIONS

The Present application claims priority from Japanese application JP 2014-218209 filed on Oct. 27, 2014, the content of which is hereby incorporated by reference into this application.

BACKGROUND

The present invention relates to a display drive circuit. Particularly, it relates to a display drive circuit which can be used as a display drive circuit operable to perform an action involving backlight control.

In recent years, the screen size of display panels including LCD panels has increased (LCD: Liquid Crystal Display). So, the demand for reduction in power consumption by backlight control and other demands accompanying such reduction in the aspect of image quality are becoming higher. To fulfill the demands, e.g. a backlight control method based on the histogram of an image to be displayed, which is termed CABC (Contents Adaptive Backlight Control), and image processing termed CE (Color Enhancement) to improve the image quality involved with the backlight control have been proposed.

JP-A-2008-129302 and JP-A-2009-098617 each disclose a display driver which practices the above backlight control method based on the histogram of an image.

JP-A-2013-101354 discloses a display driver capable of adjusting the chroma according to the characteristics of a display panel.

JP-A-2013-190777 discloses a method for operating a display driver which includes the steps of: making mutual comparisons of successively input first frame data on CRCs (CRC: Cyclic Redundancy Check); making mutual comparisons of successively input second frame data in case that the first frame data match with each other in CRC; and going into a panel-self refresh mode incase that the second frame data match with each other. Here, the panel-self refresh mode refers to a mode arranged so that in case that video data output by a host processor are of a still video, the host processor is stopped from outputting the video data, and video data saved in a memory (e.g. a frame buffer (Frame Buffer) included in a display controller are displayed (see Paragraph No. 0003 of JP-A-2013-190777).

The inventor has made examination on the following patent documents: JP-A-2008-129302; JP-A-2009-098617; JP-A-2013-101354; and JP-A-2013-190777.

SUMMARY

A circuit apparatus is provided for driving source electrodes of a display panel connected therewith based on image data and to control a backlight of the display panel. In one example, the circuit apparatus includes a display drive circuit having a parameter generation part and an image data conversion part. The parameter generation part is operable to generate an image data-conversion parameter and a backlight control parameter based on a brightness distribution of the image data of one frame. The image data conversion part is operable to convert the image data based on the image data-conversion parameter. The display drive circuit is operable to output source signals generated based on the converted image data and output; control the backlight based on the backlight control parameter, and stop an action of the parameter generation part in response to no change in the image data of one frame from image data of a preceding frame being detected.

In another example, a circuit apparatus for driving source electrodes of a display panel connected therewith based on image data is provided that includes a display drive circuit. The display drive circuit includes a parameter generation part and an image data conversion part. The parameter generation part is operable to generate an image data-conversion parameter based on a brightness distribution of the image data of one frame. The image data conversion part is operable to convert the image data based on the image data-conversion parameter. The display drive circuit is configured to generate source signals for driving source electrodes of a display panel based on the converted image data and output, and stop an action of the parameter generation part in response to no change in the image data of one frame from image data of a preceding frame being detected.

DETAILED DESCRIPTION

Figure 1:
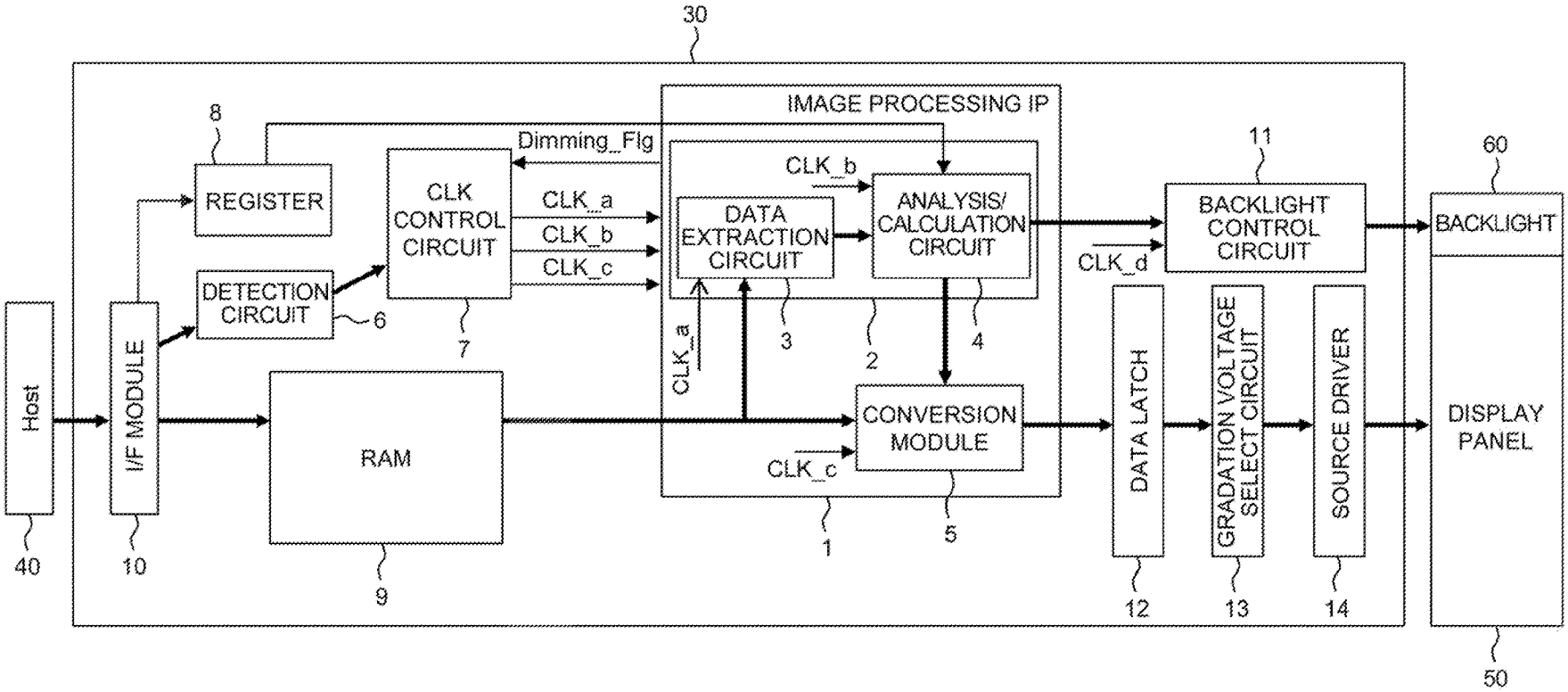
FIG. 1 is a block diagram showing an example of the structure of a display drive circuit according an embodiment.

After the examinations about the patent documents JP-A-2008-129302, JP-A-2009-098617, JP-A-2013-101354, and JP-A-2013-190777, the inventor found a new problem as described below.

A display drive circuit (display driver) involves an image processing IP (Intellectual Property) for execution of image processes such as CABC and CE as described above, and the gate scale thereof is increased. Associated with this, the power consumption attributed to the image processing IP is increased as well, so there is a growing need for reducing the power consumption.

The display driver described in the patent document JP-A-2013-190777 makes comparison between image data of successively input frames in CRC to determine whether or not there is a change therebetween, or it makes comparison between image data of the immediately preceding frame held on a frame memory and input image data to determine whether or not the image is a still image. In case that the image is determined to be a still image, the display driver stops the supply of image data from a host processor and instead, repeatedly reads out image data held by the frame memory to display the image thereof. In the image processing described in each of the first to third patent documents JP-A-2008-129302, JP-A-2009-098617, and JP-A-2013-101354, the image processing is repeated on frames having image data identical to each other, which is wasteful. Therefore, it is expected that the technique described in JP-A-

2013-190777 enables the reduction in the power consumption in case that the image is determined to be a still image. However, the technique described in JP-A-2013-190777 requires a frame memory for comparison between frames in image data. Further, in the image processing described in each of the first to third patent documents JP-A-2008-129302, JP-A-2009-098617, and JP-A-2013-101354, unless an additional frame memory to hold the result of image processing of one frame is provided, it is impossible to stop the supply of image data from the host processor and the image processing in case that the image is determined to be a still image. However, in this case the chip area occupied by the frame memory in a display driver IC (Integrated Circuit) is very large, and a frame memory for holding the result of the image processing cannot be added because of the restriction in terms of the cost.

An advantage of the present disclosure to reduce the power consumption by the image processing IP when an input image is still one without adding a frame memory for holding the result of the image processing.

The means for solving the problem like this is described below. Other problems and novel features of the invention will become clear from the description hereof and the accompanying drawings.

According to an embodiment, a display drive circuit as described below is provided.

The display drive circuit operable to output source signals for driving source electrodes of a display panel connected therewith based on image data, and to control the backlight of the display panel includes: a parameter generation part operable to generate an image data-conversion parameter and a backlight control parameter based on a brightness distribution (histogram) of image data in one frame; and an image data conversion part operable to convert the image data based on the generated image data-conversion parameter. The display drive circuit produces and outputs source signals based on the converted image data, and controls the backlight based on the generated backlight control parameter. The display drive circuit stops the parameter generation part from working in case that no change in image data in one frame from image data of the frame immediately preceding the one frame is detected.

The effect achieved by the above embodiment will be briefly described below.

The power consumption by the image processing IP when an input image is still one can be reduced without adding a frame memory for holding the result of the image processing and therefore, the power consumption of a display drive circuit can be lowered.

1. Summary of the Embodiments

First, summary of representative embodiments of the invention disclosed in the application will be described. Reference numerals in drawings in parentheses referred to in description of the summary of the representative embodiments just denote components included in the concept of the components to which the reference numerals are designated.

[1] Stop of an Unnecessary Action in the Image Processing IP in Still Image Display According to a representative embodiments disclosed in the present application, a display drive circuit (30) operable to output source signals for driving source electrodes of a display panel (50) connected therewith based on image data and to control a backlight (60) of the display panel is arranged as described below.

The display drive circuit includes: a parameter generation part (2) operable to generate an image data-conversion parameter and a backlight control parameter based on a brightness distribution of the image data of one frame; and an image data conversion part (5) operable to convert the image data based on the image data-conversion parameter.

The display drive circuit produces and outputs the source signals based on the converted image data (12, 13, 14), and controls the backlight based on the backlight control parameter (11).

The display drive circuit stops the parameter generation part from working (7) in case that no change in the image data of one frame from image data of a preceding frame is detected (6).

According to the arrangement like this, the power consumption of the image processing IP when an input image is a still image can be reduced without adding a frame memory for holding results of image processing, and the power consumption of the display drive circuit (display driver) can be reduced. Here, it is not necessary to immediately stop the action of the parameter generation part even in case that no change in the image data of one frame from image data of a preceding frame is detected. For instance, as described later, the display drive circuit may be arranged to wait for the end of a dimming period in which the image data-conversion parameter and the backlight control parameter are gradually changed, and to stop the action of the parameter generation part.

[2] Built-in RAM, and Detection of RAM Write Command

In the item #1, the display drive circuit further includes a memory (9) for holding the image data of one frame and supplying the image data to the image data conversion part. In the display drive circuit, an action of the parameter generation part is stopped in case that no issue of an image data write command to the memory is detected over a one-frame or longer period; and the action of the parameter generation part is resumed in case that the issue of the write command is detected.

According to the arrangement like this, the detection of a still image can be performed readily in a display drive circuit having a built-in frame memory. In the case of displaying a still image, provided that the display image is changed to another, or the case of displaying a moving image, a write of image data into the frame memory takes place. Therefore, by detecting a command for the write, the stop and resumption of the action of the parameter generation part can be controlled with a simple circuit.

[3] Host Interface and Command Detection Circuit

In the item #2, the display drive circuit includes: an interface (10) for receiving a command from an external host processor (40) and the image data; and a detection circuit (6) capable of detecting that a command received with the interface is the write command.

The detection circuit stops the action of the parameter generation part in case that no issue of an image data write command to the memory is detected over a one-frame or longer period, and resumes the action of the parameter generation part in case that the issue of the write command is detected (16).

According to the arrangement like this, the detection of a still image can be performed readily in a display drive circuit having a built-in frame memory.

[4] MIPI-DSI

In the item #3, the interface is compliant with MIPI-DSI standards.

According to the arrangement like this, the detection circuit can readily detect a still image even with a simplified circuit by detecting a command of 2Ch or 3Ch, which is a RAM write command of MIPI.

[5] Detection of Write to Register

The display drive circuit in any one of the items #2 to #4 further includes a register (8) for holding an adjustment parameter to supply to the parameter generation part, wherein the action of the parameter generation part is stopped in case that neither write of the adjustment parameter to the register nor issue of the write command is detected over a one-frame or longer period; and the action of the parameter generation part is resumed in case that the occurrence of a write of the adjustment parameter to the register or the issue of the write command is detected (15, 16, 17).

The arrangement like this makes possible to produce an appropriate image data-conversion parameter and an appropriate backlight control parameter without stopping the action of the parameter generation part in case that any change is caused in the adjustment parameter to which the parameter generation part makes reference.

[6] Stop of the Action of the Parameter Generation Part after Waiting for the Dimming Period to Elapse In the item #5, the parameter generation part has a dimming period for gradually changing the image data-conversion parameter and the backlight control parameter based on their values after change in case that at least one of the brightness distribution of the image data of one frame and the adjustment parameter is changed. The display drive circuit waits for the end of the dimming period and then, stops the action of the parameter generation part in case that neither write of the adjustment parameter to the register nor issue of the write command is detected over a one-frame or longer period.

The arrangement like this enables the prevention of the problem that immediately after it is detected that the display image is a still image, the dimming is stopped unexpectedly and thus, a display disturbance such as flicker occurs in the display panel.

[7] Clock Control Circuit

The display drive circuit described in any one of the items #2 to #6 further includes a clock control circuit (7) capable of controlling the supply of clocks to the parameter generation part, wherein the supply of clocks to the parameter generation part is stopped in stopping the action of the parameter generation part.

According to the arrangement like this, the power consumption of the parameter generation part can be reduced by a simple circuit.

[8] Display Driver IC (with Built-in RAM)

In the display drive circuit described in anyone of the items #2 to #7, the parameter generation part, the image data conversion part and the memory are formed on a common semiconductor substrate.

According to the arrangement like this, the power consumption of a display driver IC having a built-in frame memory (RAM) can be reduced.

[9] Detection Circuit in Display Driver without a Built-in Frame Memory

The display drive circuit described in the item #1 further includes: an interface (10) for receiving the image data from an external host processor (40); and a detection circuit (6) to be supplied with the image data received through the interface.

The parameter generation part has a data extraction circuit (3) which is supplied with the image data received through the interface, and extracts the brightness distribution from the image data of one frame supplied thereto, and an analysis/calculation circuit (4) operable to produce the image data-conversion parameter and the backlight control parameter based on a result of the extraction.

The detection circuit is capable of making a detection on whether or not the image data match with image data input one frame before. The detection circuit stops an action of the analysis/calculation circuit in case that the result of the detection is a match therebetween, otherwise resumes the action of the analysis/calculation circuit.

According to the arrangement like this, the detection of a still image can be readily performed even in a display drive circuit (display driver) having no built-in frame memory. In each display drive circuit described in items #2 to #8, the action of the parameter generation part, including the action of the data extraction circuit can be stopped. In contrast, the display drive circuits described in the item #9 and subsequent items each have no built-in frame memory and therefore, the action (of the data extraction circuit) for extraction of a brightness distribution is executed in parallel with the detection (the action of the detection circuit) on whether or not the display image is a still image. In case that the display image is not determined to be a still image, the image data-conversion parameter and the backlight control parameter for the frame in question can be calculated by the analysis/calculation circuit immediately.

[10] Detection Circuit in which Image Data of One Frame are Substituted into a Function In the item #9, the detection circuit substitutes image data of two successively input frames into a predetermined function by frame to calculate values of the function (18), and makes a mutual comparison between two values of the function calculated from the two successive frames (19_1, 19_2, 20), thereby making a detection on whether or not the image data match with image data input one frame before.

The arrangement like this substantially eliminates the need for making comparisons on all the image data in frames respectively and therefore, the detection of a still image can be performed by a simple circuit.

[11] Detection Circuit Uses CRC (Cyclic Redundancy Check)

In the item #10, the predetermined function is a cyclic redundancy check (18).

According to the arrangement like this, the detection circuit operable to detect that an input image is a still image can be formed by a simple circuit. In addition, appropriately designing the generator polynomial of a cyclic redundancy check (CRC), the probability of wrong detection attributed to production of identical function values from different images can be reduced.

[12] Detection of Write to the Register

The display drive circuit described in any one of the items #9 to #11 further includes a register (8) for holding an adjustment parameter to be supplied to the parameter generation part. The display drive circuit stops the action of the analysis/calculation circuit in case that neither write of the adjustment parameter to the register (15) nor issue of the write command (16) is detected over a one-frame or longer period, and resumes the action of the analysis/calculation circuit in case that the occurrence of a write of the adjustment parameter to the register or the issue of the write command is detected.

The arrangement like this makes possible to produce an appropriate image data-conversion parameter and an appropriate backlight control parameter without stopping the action of the analysis/calculation circuit in case that any change is caused in the adjustment parameter to which the parameter generation part makes reference.

[13] Stopping the Action of the Analysis/Calculation Circuit after Waiting for the Elapse of the Dimming Period In the item #12, the parameter generation part has a dimming period for gradually changing the image data-conversion parameter and the backlight control parameter based on their values after change in case that at least one of the brightness distribution of the image data of one frame and the adjustment parameter is changed.

The display drive circuit waits for the end of the dimming period and then, stops the action of the analysis/calculation circuit in case that neither write of the adjustment parameter to the register nor issue of the write command over a one-frame or longer period is detected.

The arrangement like this enables the prevention of the problem that immediately after it is detected that the display image is a still image, the dimming is stopped unexpectedly and thus, a display disturbance such as flicker occurs in the display panel.

[14] Clock Control Circuit

The display drive circuit described in any one of the items #9 to #13 further includes a clock control circuit (7) capable of controlling the supply of clocks to the analysis/calculation circuit, wherein the supply of clocks to the analysis/calculation circuit is stopped at the time of stopping the analysis/calculation circuit.

According to the arrangement like this, the power consumption of the analysis/calculation circuit can be reduced by a simple circuit.

[15] Display Driver IC (without RAM)

In the display drive circuit described in anyone of the items #9 to #14, the parameter generation part, and the image data conversion part are formed on a common semiconductor substrate.

According to the arrangement like this, the power consumption of a display driver IC having no built-in frame memory (RAM) can be reduced.

[16] Stopping an Unnecessary Action in the Image Processing IP in Still Image Display A display drive circuit (30) according to the representative embodiment disclosed in the present application outputs source signals for driving source electrodes of a display panel (50) connected therewith based on image data and controls a backlight (60) of the display panel. The display drive circuit is arranged as described below.

The display drive circuit includes: a parameter generation part (2) operable to generate an image data-conversion parameter based on a brightness distribution of the image data of one frame; and an image data conversion part (5) operable to convert the image data based on the image data-conversion parameter.

In the display drive circuit, the source signals are generated based on the converted image data and output (12, 13, 14).

The display drive circuit stops an action of the parameter generation part (7) in case that no change in the image data of one frame from image data of a preceding frame is detected (6).

According to the arrangement like this, even in the case of involving no backlight control, the power consumption of the image processing IP when an input image is a still image can be reduced without adding a frame memory for holding a result of image processing and therefore, the power consumption of the display drive circuit can be reduced.

[17] Detection of RAM Write Command and/or Register Update with Built-in RAM

The display drive circuit described in the item #16 further includes: a memory (9) for holding the image data of one frame and supplying the image data to the image data conversion part; a register (8) for holding an adjustment parameter to supply to the parameter generation part; and a detection circuit (6).

The detection circuit stops the action of the parameter generation part in case that neither write of the adjustment parameter to the register nor issue of the image data write command to the memory is detected over a one-frame or longer period, and resumes the action of the parameter generation part in case that the occurrence of a write of the adjustment parameter to the register or the issue of the write command is detected (15, 16, 17).

According to the arrangement like this, an appropriate image data-conversion parameter can be produced without stopping the action of the parameter generation part in a display drive circuit having a built-in frame memory in case that a change in input image data or a change in the adjustment parameter to which the parameter generation part makes reference is caused.

[18] Detection Circuit in the Display Driver Having No Built-in Frame Memory

The display driver described in the item #16 further includes: an interface (10) for receiving the image data from an external host processor; a detection circuit (6) to be supplied with the image data received through the interface; and a register (8) for holding an adjustment parameter to supply to the parameter generation part.

The parameter generation part has a data extraction circuit (3) which is supplied with the image data received through the interface, and extracts the brightness distribution from the image data of one frame supplied thereto, and an analysis/calculation circuit (4) operable to produce the image data-conversion parameter and the backlight control parameter based on a result of the extraction.

The detection circuit is capable of making a detection on whether or not the image data match with image data input one frame before. The detection circuit stops an action of the analysis/calculation circuit in case that the result of the detection is a match therebetween, otherwise resumes the action of the analysis/calculation circuit.

According to the arrangement like this, an appropriate image data-conversion parameter and an appropriate backlight control parameter can be produced without stopping the action of the analysis/calculation circuit even in a display drive circuit having a built-in frame memory in case that a change in input image data or a change in the adjustment parameter to which the parameter generation part makes reference is caused.

2. Further Detailed Description of the Embodiments

The embodiments will be described further in detail.

First Embodiment

FIG. 1 is a block diagram showing an example of the structure of a display drive circuit 30 according to the first embodiment.

The display drive circuit (display driver) 30 is connected with a display panel 50 and its backlight 60, and a host processor (Host) 40. The display driver outputs source signals for driving source electrodes of the display panel 50 based on image data supplied from the host processor 40, and controls the backlight 60. In this control, the control method is e.g., CABC described above. In the method, the display driver determines a brightness frequency distribution (histogram) of image data of one frame and lowers the brightness of the backlight 60 according to the maximum. On the other hand, the display driver shifts the source signal output toward a higher brightness side (a higher transmittance side in LCD), whereby a power consumption corresponding in quantity to a decrease in the brightness of the backlight can be lowered while displaying the same image as in the case of displaying input image data as they are (without performing any conversion thereon). The display driver 30 is connected with the host processor 40 in conformity to a standard communication interface e.g. MIPI-DSI (Mobile Industry Processor Interface Display Serial Interface). The display panel 50 is an active matrix type display panel, e.g. an LCD panel, which has scan (gate) lines and signal (source) lines which are provided to intersect with each other at right angles, and a pixel cell provided at each intersection point of the scan and signal lines. The display driver 30 drives, in parallel, the signal (source) lines in connection with the pixel cells selected by the scan (gate) lines at signal levels each depending on the brightness to be displayed.

The display driver 30 includes: an I/F module 10 serving as a communication interface with the host processor 40; a source driver 14 for driving signal (source) lines of the display panel 50 in parallel; and a backlight control circuit 11 for controlling the backlight 60. The display driver 30 further includes: an image processing IP 1; a detection circuit 6; a clock (CLK) control circuit 7; a register 8; a RAM (Random Access Memory) 9; a data latch 12; and a gradation voltage select circuit 13. The image processing IP 1 includes: a parameter generation part 2 having a data extraction circuit 3 and an analysis/calculation circuit 4; and a conversion module 5. While no signal line bus is shown in FIG. 1, each signal line is appropriately formed by one or more pieces of wiring. This applies to the circuits shown in FIGS. 2, 4 and 5, which will be described later. The display driver 30 may be arranged to further include other circuits, e.g. a gate driver for driving scan (gate) lines of the display panel 50, a touch panel controller in the case of the display panel 50 having a touch panel laminated thereon, or both of them. Although no special restriction is intended, the display driver 30 is formed on a single semiconductor substrate of silicon or the like by e.g., a known CMOS (Complementary Metal-Oxide-Semiconductor field effect transistor) LSI (Large Scale Integrated circuit) manufacturing technique, and flip-chip mounted on a glass board or another of the display panel 50. In this way, mount and wiring areas of the display panel 50 can be reduced, thereby making a contribution to the achievement of a low cost and a narrower frame.

In the display driver 30, the I/F module 10 writes various parameters in the register 8 and image data in the RAM 9 according to commands supplied from the host processor 40. The image processing IP 1 performs the image processing including e.g. CABC and CE, and the backlight control as described above under the control based on a parameter and the like stored in the register 8. In the parameter generation part 2 of the image processing IP 1, the data extraction circuit 3 counts a frequency by brightness value on image data read out from the RAM 9 over a one-frame period, thereby to extract a frequency distribution (histogram), and the analysis/calculation circuit 4 produces an image data-conversion parameter and a backlight control parameter based on the frequency distribution thus extracted. The conversion module 5 converts image data read out from the RAM 9 based on the image data-conversion parameter, and writes the resultant image data into the data latch 12. The data latch 12 temporarily stores converted image data representing one line, and supplies them to the gradation voltage select circuit 13 in parallel. The gradation voltage select circuit 13 produces, from gradation reference voltages supplied by a gradation-reference-voltage-generating circuit, gradation voltages corresponding to image data supplied by the data latch 12, provided that the gradation-reference-voltage-generating circuit is not shown in the drawing. The image data supplied by the data latch 12 are of digital values; the gradation voltage select circuit 13 serves as a kind of digital-to-analog conversion circuit which converts the image data of digital values into gradation voltages of analog voltage levels corresponding to the digital values. The conversion characteristic curve of the gradation voltage select circuit is not necessarily linear, and it has a gamma characteristic. While the illustration is omitted, the parameters to store in the register 8 may include a parameter for defining the gamma characteristic. The source driver 14 drives the signal (source) lines of the display panel 50 with gradation voltages thus produced. The backlight control circuit 11 controls the backlight 60 in brightness based on the backlight control parameter produced by the image processing IP 1. The brightness of the backlight 60 can be adjusted by e.g. PWM of a driven power source (PWM: Pulse Width Modulation); and the degree of the modulation (i.e. a duty ratio which is a ratio of High period vs. Low period) is given as a backlight control parameter.

The action of the display driver 30 will be described taking, as an example, a case in which CABC and CE are executed by the image processing IP 1. The maximum brightness value P in one frame can be obtained from a frequency distribution (histogram) of the one frame extracted by the data extraction circuit 3. The analysis/calculation circuit 4 determines a ratio (P/M) of the maximum brightness value P to a gradation maximum value M given to image data, calculates a backlight control parameter so that the brightness of the backlight 60 is reduced according to the ratio (P/M) and in parallel, produces an image data-conversion parameter so that image data read out from the RAM 9 are amplified at the reciprocal (M/P) of the ratio. As image data input from the host processor 40 are multiplied by M/P, and the brightness of the backlight 60 is multiplied by P/M, the product thereof coincides with the input image data. Therefore, the power consumption of the backlight 60 can be reduced without changing a display image. Further, CE may be combined with CABC; the CE is image processing which enables the enhancement of a chroma. In addition to CABC, the effect of chroma enhancement can be added by CE and thus, the visibility can be increased.

The display driver 30 is arranged to support two action modes consisting of a command mode and a video mode. In the command mode, the host processor 40 writes image data of a one-frame still image in the RAM (frame memory) 9 and since then, repeatedly reads out the one-frame data and drives the display panel 50, whereas it stops the supply of image data. In the video mode, the host processor 40 supplies image data of each frame regardless of whether the data is of a moving image or a still image. Therefore, it is allowed to bypass the write in the RAM 9 and directly input image data to the conversion module 5 of the image processing IP 1. In case that the image processing is not performed, the display driver may be arranged so that image data are directly written in the data latch 12.

With the display driver 30 working in the command mode, image data of a one-frame still image are repeatedly read out from the RAM 9, converted by the conversion module 5, and supplied to the latch circuit 12. Since a display image is a still image, the frequency distribution extracted by the data extraction circuit 3 never changes by frame. Therefore, the image data-conversion parameters produced by the image processing IP 1 take values identical with each other. As a result, during a period in which the still image is displayed, the conversion processing is repeatedly executed on image data identical with each other using a common image data-conversion parameter.

Detection Circuit and Clock Control

Detecting that a display image is a still image, the detection circuit 6 causes part of the actions in the image processing IP 1 to stop. More specifically, the supply of clocks by the clock control circuit 7 is stopped. The clock control circuit 7 is arranged to be able to stop a clock CLK_a to supply to the data extraction circuit 3, a clock CLK_b to supply to the analysis/calculation circuit 4, a clock CLK_c to supply to the conversion module 5, and a clock CLK_d to supply to the backlight control circuit 11 independently of each other. During an action in the command mode, the frequency distribution extracted by the data extraction circuit 3 remains unchanged between frames and therefore, in case of detection of a still image, the action of extracting a frequency distribution may be stopped from the subsequent frame, when the clock CLK_a is stopped. In case that the same image data-conversion parameter and the same backlight control parameter are calculated from the same frequency distribution, the analysis/calculation circuit 4 may be stopped from working. At this time, the clock CLK_b is further stopped, whereas the clocks CLK_c and CLK_d remain supplied to the conversion module 5 and the backlight control circuit 11 respectively. This is because image data require writing into the data latch 12 for each line, so even if the image processing will be repeated from frame to frame, the image data conversion needs to be executed for each line. In addition, the brightness of light emission by the backlight 60 is controlled by PWM and therefore, the backlight control circuit 11 is required to supply the clock CLK_d constantly. If the display driver 30 is arranged to have a memory device capable of holding one-frame image data after the conversion, the supply of the clock CLK_c to the conversion module 5 can be stopped. Such memory device can be materialized by e.g. mounting a frame memory between the conversion module 5 and the data latch 12. Providing the two memories, i.e. the memory 9 and the frame memory (for two frames) would result in a large increase in circuit scale and as such, the display driver may be arranged so that the memory 9 is also used to hold image data after the conversion. In this case, the display driver may be arranged to be able to overwrite, of input image data, image data finished in their conversion with post-conversion image data in turn and then, supply the post-conversion image data from the memory 9 directly to the data latch 12 without passing through the conversion module 5.

Incase that a display image is a still image, image data supplied by the host processor 40 have the same value as long as their positions in frames are coincident to each other, and the frequency distributions of image data of the frames are coincident to each other as described above. Therefore, it is not required to keep the data extraction circuit 3 working. In this case, as long as the same image data-conversion parameter and the same backlight control parameter are produced from the same frequency distribution, the analysis/calculation circuit 4 can be stopped from working. However, some adjustment parameter can contribute to the production of the image data-conversion parameter and the backlight control parameter. For instance, in case that the lightness of the environment in which the display panel 50 is placed changes, adjustment for increasing the visibility is performed by making adjustment in chroma or luminosity. In this time, the value of an adjustment parameter based on an exterior light illumination intensity is changed and consequently, the values of the image data-conversion parameter and the backlight control parameter are recalculated. As described above, the detection circuit 6 detects not only no change in image data, but also no change in the adjustment parameter to which reference is made by the image processing IP 1 and thus, stops the clock to the analysis/calculation circuit 4. In contrast, in case of a change in adjustment parameter, the analysis/calculation circuit 4 is caused to resume working; in case of a change in image data, the data extraction circuit 3 is caused to resume working in addition to the analysis/calculation circuit 4.

Figure 2:
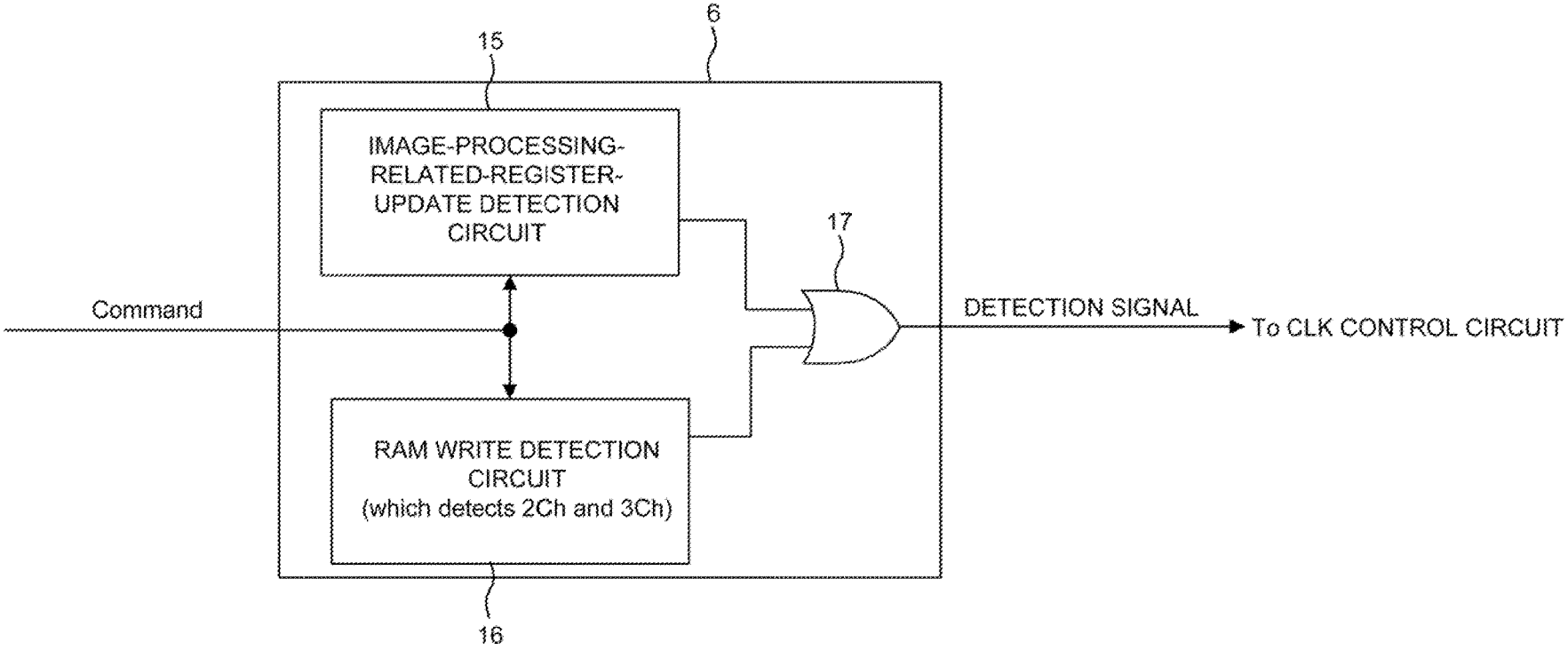
FIG. 2 is a block diagram showing an example of the structure of a detection circuit installed in the display drive circuit according to an embodiment.

FIG. 2 is a block diagram showing an example of the structure of a detection circuit 6. The detection circuit 6 includes: a RAM-write detection circuit 16; an image-processing-related-register-update detection circuit 15; and an OR circuit 17 operable to take a logical sum of results of detection by the detection circuits 15 and 16. The RAM-write detection circuit 16 can detect that a display image is a still image; the detection is performed by monitoring a write command to the RAM 9 instead of monitoring image data supplied from the host processor 40. In case that the write command for writing image data of a subsequent frame into the RAM 9 is not received over a one-frame period, a display image can be determined to be a still image. For instance, in case that a communication path between the host processor 40 and the I/F module is compliant with MIPI, 2Ch (in the notation "XYh", "h" is a notation showing that "XY" is a two-digit hexadecimal number) and 3Ch which are RAM write commands of MIPI are detected. The arrangement like this allows the display driver 30 having a built-in frame memory to readily perform a still image detection. In the case of displaying a still image, provided that the display image is changed to another, or the case of displaying a moving image, a write of image data into the frame memory takes place in the course of the display. Therefore, by detecting a command for the write, the stop and resumption of the action of the parameter generation part can be controlled with a simple circuit. Making arrangement for detection of the command 2Ch or 3Ch which is a RAM write command of MIPI, the RAM-write detection circuit 16 is simplified. Therefore, even if the entire detection circuit 6 is made a simplified circuit, the detection of a still image can be performed readily.

The image-processing-related-register-update detection circuit 15 can detect the update of an image-processing-related register by e.g., detecting a write command to a register to which reference is made by the image processing IP 1, or detecting that a write enable signal of the register per se or the like is asserted. According to the arrangement like this, in case that the adjustment parameter to which reference is made by the parameter generation part 2 is changed, e.g. only the analysis/calculation circuit 4 may be operated without stopping the action of the whole parameter generation part 2; the analysis/calculation circuit 4 applies the updated adjustment parameter to the same frequency distribution data, and produces a new image data-conversion parameter and a new backlight control parameter, whereby the parameters can be updated.

While the example for reducing the power consumption by the method for stopping the supply of clocks to the parameter generation part 2 has been described above, another method for reducing the power consumption or a combination thereof may be adopted instead. For instance, the supply of a power source may be stopped instead of clocks.

Dimming Period

The frequency distribution of a one-frame image can be remarkably changed in changing a display image from a still image to another still image or from a moving image to a still image. In this time, the image data-conversion parameter and the backlight control parameter which are to be updated are largely changed as well. In case that with such large changes, the image data-conversion parameter and the backlight control parameter which are used actually are sharply changed, the visual degradation of image quality such as flicker can be caused in a displayed image. Hence, a display method by which the values of the image data-conversion parameter and the backlight control parameter are gradually changed toward original post-update values over one or more frame periods has been known. In the display method like this, a period in which the parameter values are changed gradually is referred to as "dimming period".

In some cases, a command for writing image data into the RAM is not detected between two successive frames and the image-processing-related register is not updated and as such, the detection circuit 6 is controlled to assert a detection signal showing that the display image is a still image and to cause the clock control circuit 7 to stop the supply of a predetermined clock as described above. In case that the clock control circuit 7 stops the supply of both of the clocks CLK_a and CLK_b to the data extraction circuit 3 and the analysis/calculation circuit 4 from the subsequent frame immediately after a detection signal output by the detection circuit 6 is asserted, the visual degradation of image quality as described above can be caused. Hence, the image processing IP 1 is arranged to output, to the clock control circuit 7, a dimming flag (Dimming_Flg) to assert during a dimming period. The clock control circuit 7 keeps supplying the clock CLK_b to the analysis/calculation circuit 4 even with a detection signal from the detection circuit 6 asserted during a period in which the dimming flag (Dimming_Flg) is asserted. The clock control circuit waits for the dimming flag (Dimming_Flg) to be negated after the end of the dimming period and then, stops supplying the clock CLK_b to the analysis/calculation circuit 4. At this time, the supply of the clock CLK_a to the data extraction circuit 3 may be stopped from the subsequent frame period earlier without waiting the end of the dimming period. This is because in case that no RAM write command is detected, new image data are not written into the RAM 9, it is not necessary to operate the data extraction circuit 3 on the same image data again. On the other hand, the analysis/calculation circuit 4 is executing a process for gradually changing the value of the image data-conversion parameter and the value of the backlight control parameter to values corresponding to a frequency distribution extracted by the data extraction circuit 3 and as such, the supply of the clock CLK_b needs to be continued during the period (dimming period).

Example of the action of the display driver 30

Now, the example of the action of the display driver 30 will be described further in detail.

Figure 3:
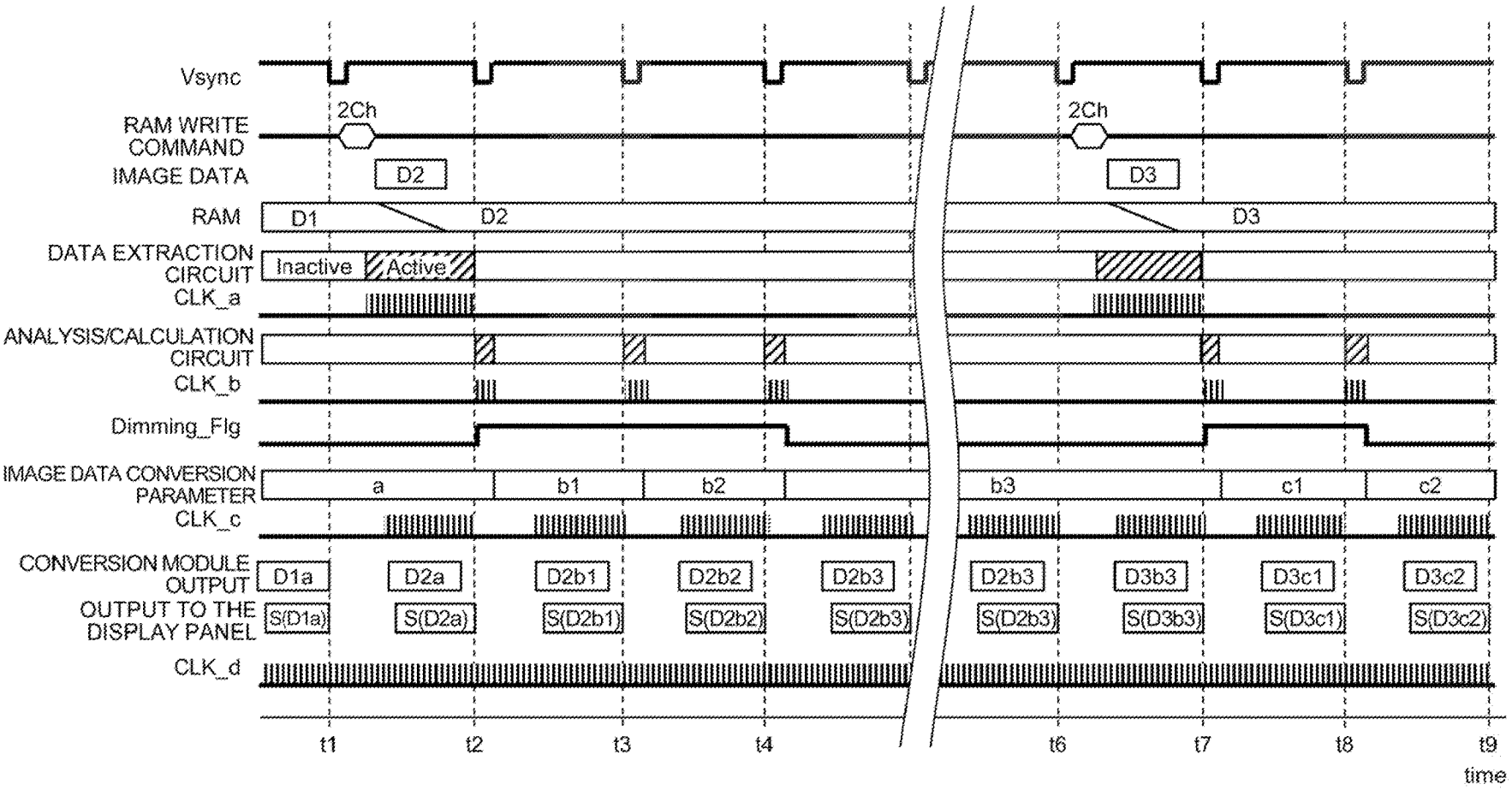
FIG. 3 is a timing chart showing an example of the action of the display drive circuit according to an embodiment.

FIG. 3 is a timing chart showing an example of the action of the display driver 30. In FIG. 3, the horizontal axis represents the time (time), whereas in the vertical axis direction, the following are schematically shown from the top in turn: a vertical synchronizing signal Vsync; the RAM write command and image data which are supplied from the host processor 40; image data written in RAM 9; the action of the data extraction circuit 3; the clock CLK_a; the action of the analysis/calculation circuit 4; the clock CLK_b; the dimming flag (Dimming_Flg); the image data-conversion parameter; the clock CLK_c; the output from the conversion module 5; the output to the display panel 50; and the clock CLK_d.

In the period until the time t1, the RAM 9 stores image data D1, the value of the image data-conversion parameter used by the conversion module 5 is "a". According to this, data output from the conversion module 5 to the data latch 12 are D1*a*, and passed through the gradation voltage select circuit 13 where the data are converted into analog voltages; signals output by the source amplifier 14 to the display panel 50 are S(D1*a*). Here, "S(D1*a*)" is an analog value corresponding to the digital value D1*a*, which is represented according to a function such as "f(x)".

The period of time t1 to t2 is a one-frame period defined by the vertical synchronizing signals Vsync. The host processor 40 issues the RAM write command 2Ch and subsequently supplies image data D2, whereby image data D1 stored in the RAM 9 are overwritten with newly supplied image data D2 in turn. On detection of the RAM write command 2Ch, the detection circuit 6 resumes the clock CLK_a, thereby resuming the action of the data extraction circuit 3. In other words, the detection circuit causes the data extraction circuit to transition from "Inactive" state to "Active" state. During this period, the clock CLK_b remains stopped, and the analysis/calculation circuit 4 remains stopped from working (in Inactive state). The conversion module 5 reads out, from the RAM 9, image data D2 written therein, converts the image data with the value "a" of the image data-conversion parameter and then, outputs a result of the conversion, i.e. a conversion module output D2*a* to the data latch 12. The conversion module output D2*a* is passed through the data latch 12, converted into an analog gradation voltage signal S (D2*a*) to output to the display panel 50 by the gradation voltage select circuit 13 and then, output through the source driver 14.

Also, each of the period of t2 to t3, and the period of t3 to t4 is a one-frame period defined by vertical synchronizing signals Vsync. The action of the data extraction circuit 3 targeted for the image data D2 has been completed until the time t2. In response to the supply of the clocks CLK_b from the time t2, the analysis/calculation circuit 4 starts working (i.e. goes into Active state), and outputs the image data-conversion parameter "b1". In this case, the value of the image data-conversion parameter corresponding to the image data D2 is "b3", and a dimming period is provided to avoid rapidly causing a large change from the value "a" before the change. So, the value of the image data-conversion parameter is gradually changed so that it becomes "b1" in the period of the time t2 to t3, and "b2" in the period of the time t3 to t4 and then, reaches the target value "b3" at the time t4. In contrast, the conversion module output is gradually changed as D2*b*1, D2*b*2 and D2*b*3, and the output to the display panel 50 is gradually changed as S (D2*b*1), S (D2*b*2) and S (D2*b*3) as well. During the dimming period, it is necessary for the analysis/calculation circuit 4 to work, so the dimming flag (Dimming_Flg) is asserted to perform control so that the clock control circuit 7 keeps supplying the clock CLK_b. During the period, no image data is input additionally and therefore, the supply of the clock CLK_a to the data extraction circuit 3 is kept stopped since the time t2.

After the time t4 until the time t6 when a subsequent RAM write command is issued, the still image of the image data D2 is displayed. During the period except the dimming period, the supplies of clocks CLK_a and CLK_b to the data extraction circuit 3 and the analysis/calculation circuit 4 are stopped and thus, the power consumption is reduced. At the time t6, a RAM write command 2Ch is issued for writing subsequent image data D3 into the RAM 9.

The period of the time t6 to t7 is also a one-frame period defined by the vertical synchronizing signals Vsync. The host processor 40 issues a RAM write command 2Ch and subsequently supplies image data D3, and thus, the image data D2 stored in the RAM 9 are overwritten with the newly supplied image data D3 in turn. On detection of the RAM write command 2Ch, the detection circuit 6 causes the clock control circuit to resume the clock CLK_a and resumes the data extraction circuit 3 to work and transition from "Inactive" to "Active" state. During the period, the clock CLK_b remains stopped, and the analysis/calculation circuit 4 remains stopped from working (in "Inactive" state). The conversion module 5 reads out image data D3 written in the RAM 9, applies the value b3 of the image data-conversion parameter, and outputs the conversion module output D3*b*3 to the data latch 12. The conversion module output D3*b*3 is passed through the data latch 12, converted, by the gradation voltage select circuit 13, into an analog gradation voltage signal S (D3*b*3) to output to the display panel 50 and then, output from the source driver 14. After the time t7 subsequent to the period, the display driver works in the same way as it does since the time t2 with the exception that the dimming period is made shorter.

While the case where the detection circuit 6 detects the RAM write command has been described with reference to the timing chart, the display driver also works in the same way even in case that the update of the image-processing-related register in the register 8 is detected. Further, the display driver may be arranged as follows: the OR circuit 17 is omitted in the detection circuit 6; and the update of the RAM write command and the update of the image-processing-related register are detected separately to make control suitable for what is updated. For instance, the display driver may be arranged as follows: in case that only the image-processing-related register is updated with no RAM write command issued, only the action of the analysis/calculation circuit 4 is resumed to update the value of the image data-conversion parameter without resuming the action of the data extraction circuit 3.

Thus, the power consumption by the display driver 30 having the built-in RAM 9 serving as a frame memory can be reduced as described above. In addition, a dimming can be provided appropriately, and the problem that a display disturbance such as flicker occurs in the display panel 50 can be substantially prevented.

While the above description was presented on the assumption that the same backlight control is performed on a whole frame, it can be applied to a local dimming as it is; in the local dimming, the backlight control is performed, by region, on a display panel having a backlight arranged so that its illumination intensity can be adjusted for each of regions into which one frame is divided.

Second Embodiment

Figure 4:
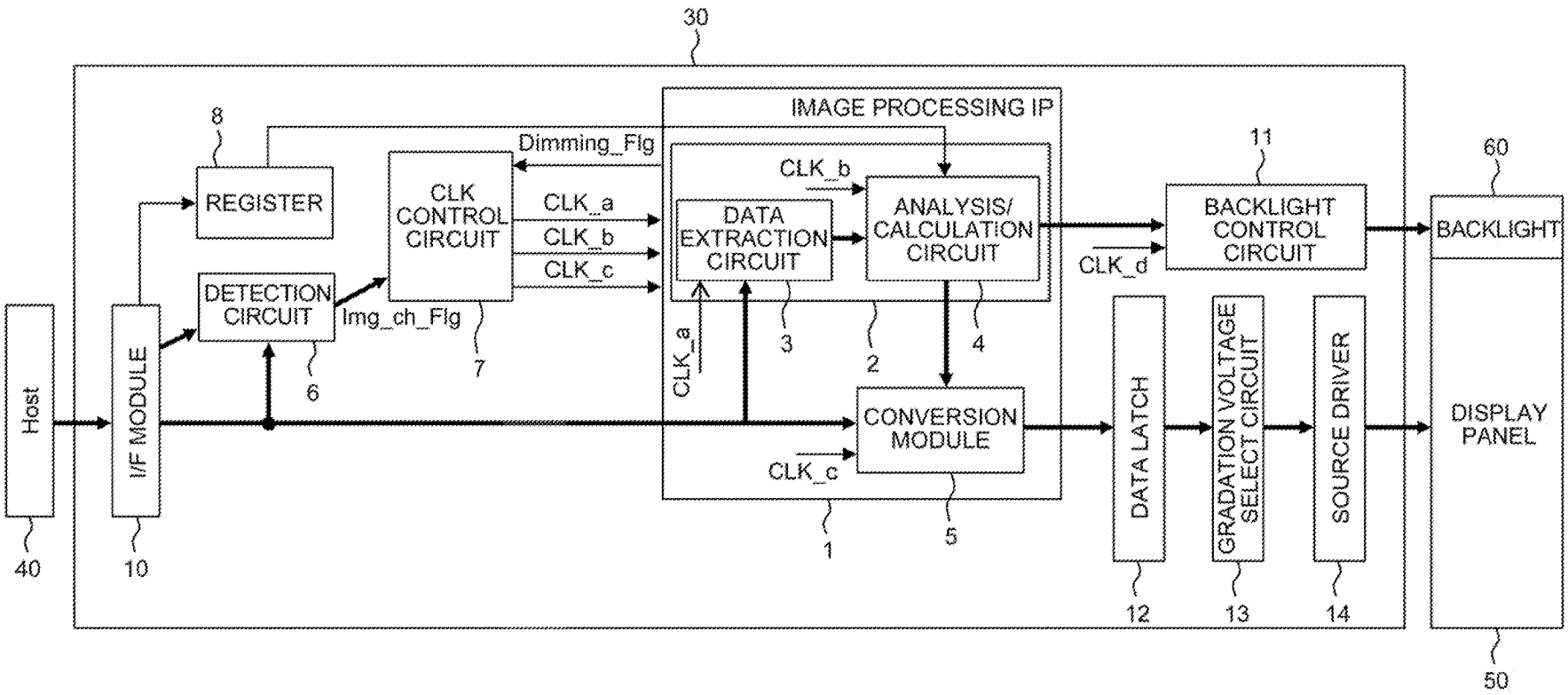
FIG. 4 is a block diagram showing an example of the structure of a display drive circuit according to an embodiment.

FIG. 4 is a block diagram showing an example of the structure of a display drive circuit 30 according to the second embodiment.

Like the display drive circuit 30 according to the first embodiment shown in FIG. 1, the display drive circuit (display driver) 30 is connected with a display panel 50, and its backlight 60, and a host processor (Host) 40, and outputs source signals for driving source electrodes of the display panel 50 based on image data supplied from the host processor 40 and in parallel, controls the backlight 60. The display driver 30 further includes: an I/F module 10; a backlight control circuit 11; an image processing IP 1; a detection circuit 6; a clock (CLK) control circuit 7; a register 8; a data latch 12; a gradation voltage select circuit 13; and a source driver 14. The image processing IP 1 has: a parameter generation part 2 including a data extraction circuit 3 and an analysis/calculation circuit 4; and a conversion module 5. The display driver 30 of the second embodiment is different from that of the first embodiment in that the RAM (frame memory) 9 is not provided therein, and the output of the detection circuit 6 is an image-change flag (Img_ch_Flg). Like the display driver 30 according to the first embodiment, the display driver 30 may be arranged to further include other circuits, e.g. a gate driver for driving scan (gate) lines of the display panel 50 and a touch panel controller in the case of the display panel 50 having a touch panel laminated thereon. For instance, the display driver 30 is formed on a single semiconductor substrate of silicon or the like by a known CMOS LSI manufacturing technique, and flip-chip mounted on a glass board or another of the display panel 50. The display driver 30 does not have the RAM (frame memory) 9 installed therein and therefore, the display driver 30 is much smaller than the display driver 30 of the first embodiment in chip area.

The display driver 30 of the second embodiment does not have the RAM (frame memory) 9, so it works in the video mode. However, its structure and actions of parts other than the detection circuit 6 are roughly the same as those of the display driver 30 of the first embodiment and as such, the description thereof will be omitted here.

Figure 5:
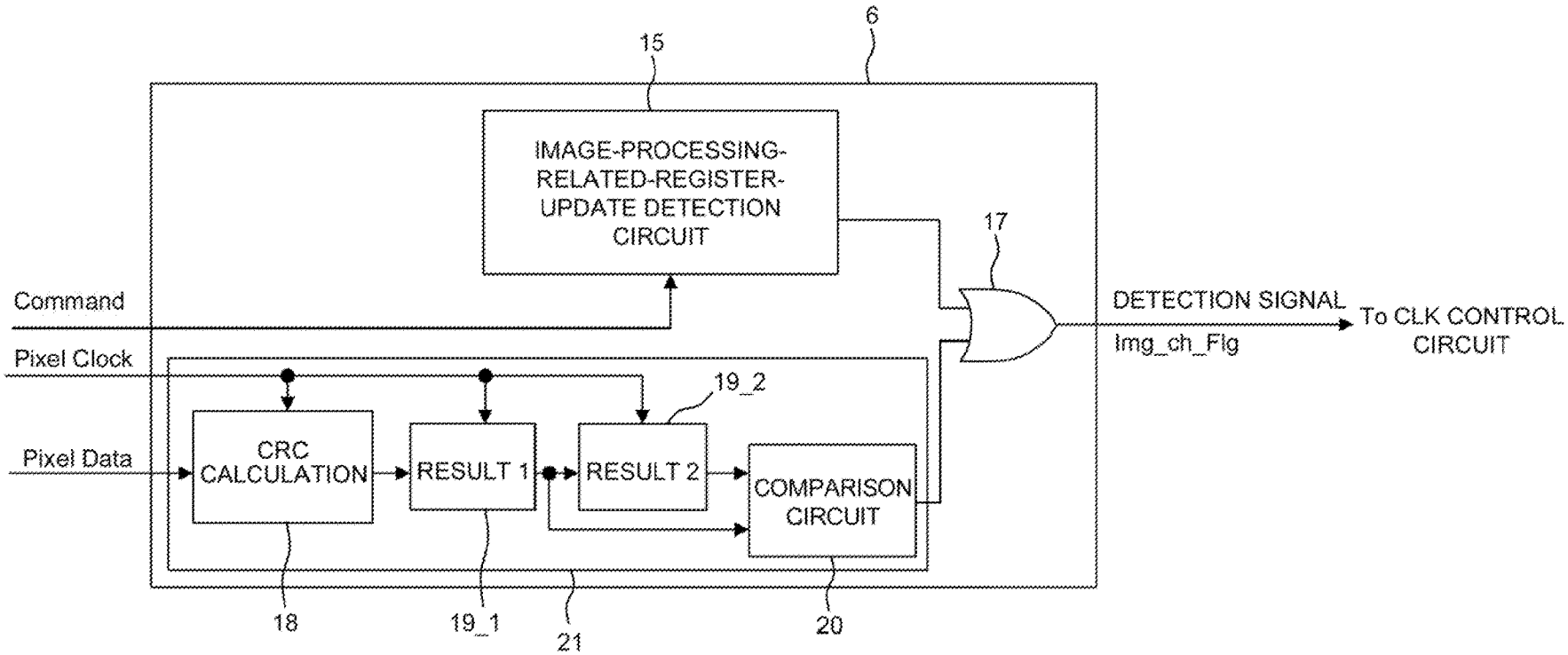
FIG. 5 is a block diagram showing an example of the structure of a detection circuit installed in the display drive circuit according to an embodiment.

FIG. 5 is a block diagram showing an example of the structure of the detection circuit 6 installed in the display driver 30 according to the second embodiment. While the detection circuit 6 shown in FIG. 2 in the first embodiment includes the RAM-write detection circuit 16 for detecting a RAM write command, the detection circuit 6 according to the second embodiment includes an image-data-change detection circuit 21 for making detection on whether or not input image data match with image data input one frame before instead of the RAM-write detection circuit 16. The image-processing-related-register-update detection circuit 15 is identical to that in the detection circuit 6 in the first embodiment described with reference to FIG. 2 and therefore, its description is omitted here. For instance, the image-data-change detection circuit 21 makes a comparison of input image data with preceding frame image data for each of pixel data of pixels forming one frame, and makes a determination on whether or not pixel data agree with each other for all the pixels. On condition that the input image data are the same as image data of the preceding frame, the image-data-change detection circuit can detect that the input image is a still image. The simple and honest comparison method like this involves a huge amount of the comparison operation, which makes a heavy load in terms of achieving the goal of reducing the power consumption. Hence, the detection circuit 6 substitutes image data of two successively input frames into a predetermined function by frame to calculate values of the function, and makes a mutual comparison between two values of the function calculated from the two successive frames, thereby making a detection on whether or not input image data match with image data input one frame before. The arrangement like this eliminates the need for performing the comparison on all of image data in a frame individually, and the detection of a still image can be performed by a simple circuit.

A hash function or a cyclic redundancy check (CRC) can be adopted as the function in this case. The image-data-change detection circuit 21 shown in FIG. 5 is one in case that a cyclic redundancy check (CRC) is adopted. The image-data-change detection circuit 21 may be arranged to include: a CRC calculation circuit 18; latch circuits 19_1 and 19_2 for storing results of CRC calculation; and a comparison circuit 20. The CRC calculation circuit 18 accepts inputs of image data of one frame (Pixel Data) sequentially, performs CRC calculation with a given generator polynomial, and outputs to the latch circuit 19_1. In response to the input of image data of a subsequent frame (Pixel Data), the result of calculation for the preceding frame is shifted to the latch circuit 19_2 of the next stage, and the result of the calculation of the new frame is written in the latch circuit 19_1. The comparison circuit 20 compares the result of the calculation of the current frame stored in the latch circuit 19_1 with the result of the calculation of the preceding frame stored in the latch circuit 19_2. In case that the calculation results match with each other, the comparison circuit 20 asserts an output signal to the OR circuit 17. Thus, the detection circuit for detecting that an input image is a still image can be formed by a simple circuit. In addition, appropriately designing the generator polynomial of cyclic redundancy check (CRC), the probability of wrong detection owing to the production of identical function values from different images can be reduced.

As described above, the detection of a still image can be performed readily even in the display driver 30 without the built-in RAM (frame memory) 9.

Example of the action of the display driver 30

The example of the action of the display driver 30 according to the second embodiment will be described further in detail.

Figure 6:
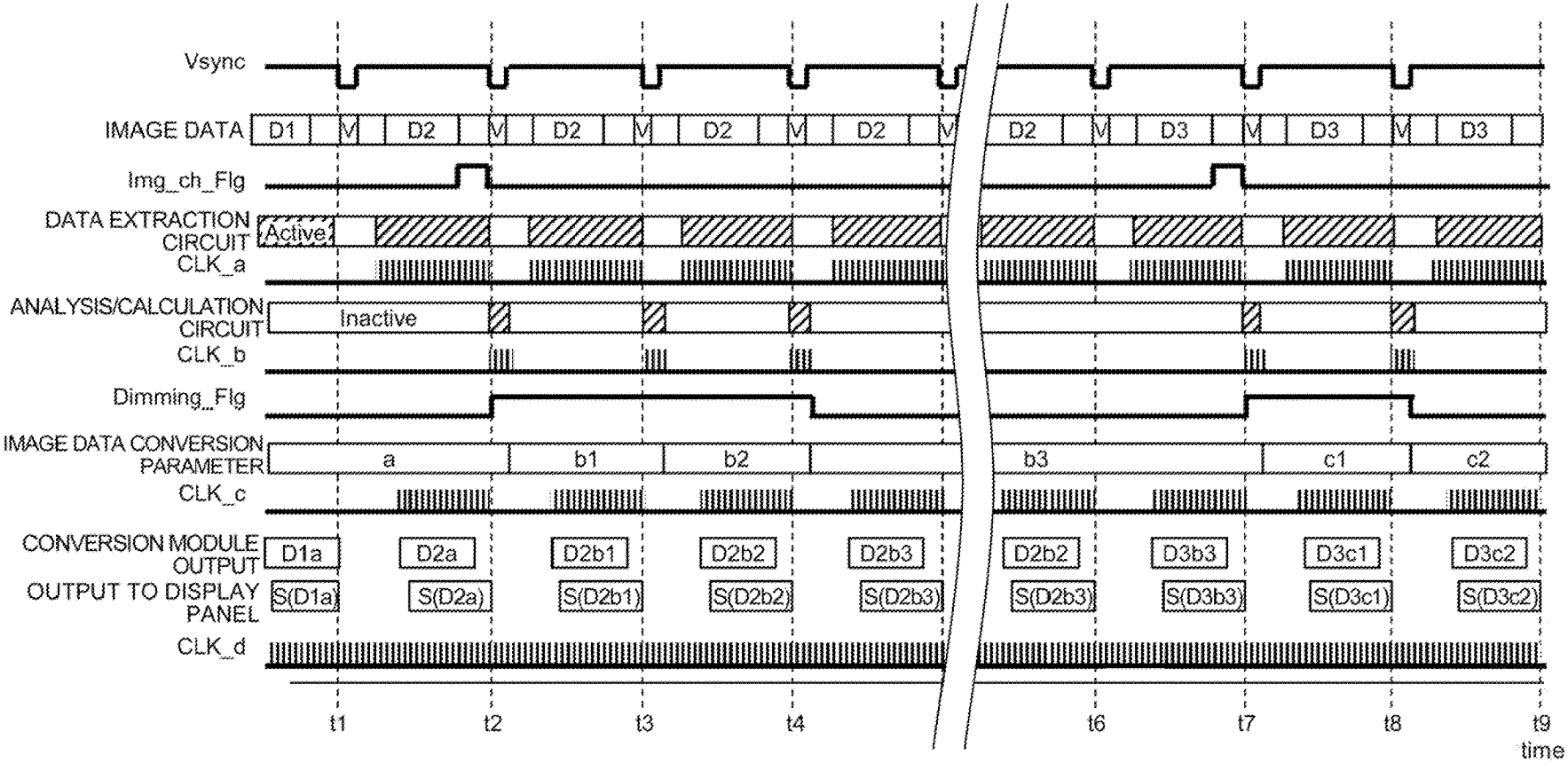
FIG. 6 is a timing chart showing an example of the action of the display drive circuit according to an embodiment.

FIG. 6 is a timing chart showing an example of the action of the display driver 30. In FIG. 6, the horizontal axis represents the time (time), whereas in the vertical axis direction, the following are schematically shown from the top in turn: a vertical synchronizing signal Vsync; a RAM write command and image data which are supplied from the host processor 40; an image-change flag (Img_ch_Flg); the action of the data extraction circuit 3; the clock CLK_a; the action of the analysis/calculation circuit 4; the clock CLK_b; the dimming flag (Dimming_Flg); the image data-conversion parameter; the clock CLK_c; the output from the conversion module 5; the output to the display panel 50; and the clock CLK_d.

The display driver 30 according to the second embodiment works in the video mode and therefore, in periods of image data formed by partitioning by commands "V" representing the vertical synchronizing signals Vsync, image data D1, D2, D3, . . . of the respective frames are input. The periods ranging from the time t1 to t6, during which the same image data D2 are input, are each a period to display the image data as a still image in. Likewise, in the periods from the time t6 to t9, image data D3 are displayed as a still image.

The image data input in the period until the time t1 are denoted by D1, and the value of the image data-conversion parameter used by the conversion module 5 is "a". According to the value, data output from the conversion module 5 to the data latch 12 are image data D1*a*, which are converted into analog voltages in the gradation voltage select circuit 13 and then, output to the display panel 50 through the source amplifier 14 as signals S(D1*a*).

In the period of the time t1 to t2, image data D2 are input from the host processor 40. The detection circuit 6 compares the input image data D2 with image data of the preceding frame and in parallel, the data extraction circuit 3 extracts the frequency distribution of the input image data D2. At the completion of input of the image data D2, the detection circuit 6 asserts the image-change flag (Img_ch_Flg). The input image data D2 are converted by the conversion module 5 using the image data-conversion parameter "a", and the conversion module output D2*a*, which is a result of the conversion, is output to the data latch 12. The conversion module output D2*a* is passed through the data latch 12, converted into an analog gradation voltage signal S(D2*a*) to output to the display panel 50 by the gradation voltage select circuit 13, and then output from the source driver 14.

Also, in the period of the time t2 to t3, the same image data D2 are input from the host processor 40. As a result of the comparison of the input image data D2 with image data of the preceding frame, the detection circuit 6 negates the image-change flag (Img_ch_Flg). In parallel with this, the data extraction circuit 3 extracts the frequency distribution of the input image data D2. Since the display image is a still image, the data extraction need not be executed again, but the data extraction for image data of the same frame need be finished at the time when the image-change flag (Img_ch_Flg) is negated. On this account, the negation and the extraction of the frequency distribution are executed in parallel. Unlike the action of the display driver 30 of the first embodiment shown in FIG. 3, the data extraction circuit 3 always works for each frame even if an input image is a still image.

The clock CLK_b is supplied from the time t2 and thus, the analysis/calculation circuit 4 starts working (goes into Active state) and then, outputs the image data-conversion parameter b1. In the second embodiment, a dimming period is provided, the image data-conversion parameter is gradually changed so that the image data-conversion parameter becomes "b1" in the period of the time t2 to t3 and "b2" in the period of the time t3 to t4, and reaches the target value "b3" at the time t4 as in the first embodiment. According to the change, the conversion module output is gradually changed as D2*b*1, D2*b*2 and D2*b*3; and the output to the display panel 50 is gradually changed as S(D2*b*1), S(D2*b*2) and S(D2*b*3). During the dimming period, the analysis/calculation circuit 4 is required to work and therefore, the dimming flag (Dimming_Flg) is asserted, and the supply of the clock CLK_b from the clock control circuit 7 is continued. The display driver waits for the end of the dimming period and then, stops the supply of the clock CLK_b.

After the time t4 until the time t6 when image data D3 different from D2 are input subsequently, the still image of the image data D2 is displayed. During the period except the dimming period, the supply of the clock CLK_b to the analysis/calculation circuit 4 is stopped and thus, the power consumption is reduced. At the time t6 the subsequent image data D3 are input and then, the detection circuit 6 detects the change and asserts the image-change flag (Img_ch_Flg). During the period of the time t6 to t7, the clock CLK_b remains stopped, and the analysis/calculation circuit 4 remains stopped from working (in Inactive state). The conversion module 5 applies the value "b3" of the image data-conversion parameter to the input image data D3, and outputs the conversion module output D3*b*3 to the data latch 12. The conversion module output D3*b*3 is passed through the data latch 12, converted, by the gradation voltage select circuit 13, into an analog gradation voltage signal S(D3*b*3) to output to the display panel 50 and then, output from the source driver 14. After the time t7 subsequent to the period, the display driver works in the same way as it does since the time t2 with the exception that the dimming period is made shorter.

While only the case where the detection circuit 6 detects a change in image data by the image-data-change detection circuit 21 has been described with reference to the timing chart, the display driver also works in the same way even in case that the update of the image-processing-related register in the register 8 is detected.

As described above, the power consumption can be reduced even in the display driver 30 without the built-in RAM 9 which is a frame memory. In addition, a dimming can be provided appropriately, and the problem that a display disturbance such as flicker occurs in the display panel 50 can be substantially prevented.

The invention made by the inventor has been concretely described above based on the embodiments. However, the invention is not limited to the embodiments. It is obvious that various changes or modifications may be made without departing from the subject matter thereof.

For instance, the display drive circuit 30 may be arranged as a one-chip semiconductor integrated circuit (IC chip) in itself, or it may be divided and mounted in IC chips. Further, the display drive circuit may be integrated with a circuit having a different function in one chip and consequently, materialized as an IC chip of high integration. While in the embodiments shown herein, the image processing IP includes a data extraction part, an analysis/calculation part, and a conversion module, the functions comparable to their functions may be integrated, or may be fractionated and mounted in the forms of different blocks. Further, part of the functions may be substituted with a software program.

What is claimed is:

1. A display driver comprising:

an interface operable to receive, from an external host processor, an image data write command and image data;

a memory configured to store a frame of the image data responsive to the image data write command;

parameter generation circuitry operable to generate an image data-conversion parameter and a backlight control parameter based on a brightness distribution of the frame of the image data;

backlight control circuitry operable to control a backlight of a display based on the backlight control parameter;

image data conversion circuitry operable to convert the image data based on the image data-conversion parameter;

source driver circuitry operable to drive source electrodes of the display with source signals that are based on the converted image data;

detection circuitry operable to:

detect whether the image data write command is received; and generate, responsive to detecting an absence of the image data write command, a detection signal with a first value indicating that there is no change between the frame and a preceding frame of the image data; and clock control circuitry configured to:

stop supplying a first clock signal to the parameter generation circuitry during a first period in response to the first value of the detection signal; and supply a second clock signal to the backlight control circuitry during the first period, wherein the parameter generation circuitry is configured to stop generating at least one of the image data-conversion parameter and the backlight control parameter responsive to the clock control circuitry stopping the supply of the first clock signal.

2. The display driver according to claim 1, wherein the detection circuitry is further operable to:

responsive to detecting a presence of the image data write command, generate the detection signal with a second value that configures the parameter generation circuitry to resume generating at least one of the image data-conversion parameter and the backlight control parameter.

3. The display driver according to claim 2, wherein detecting the absence of the image data write command comprises detecting an absence of the image data write command for a predefined period of one frame or longer.

4. The display driver according to claim 3, wherein the interface is compliant with MIPI-DSI standards.

5. The display driver according to claim 2, further comprising:

a register configured to store an adjustment parameter to supply to the parameter generation circuitry, wherein the detection circuitry is further configured to:

detect whether a write of the adjustment parameter to the register has occurred;

generate, responsive to determining that the write of the adjustment parameter has not occurred during a predefined period of one frame or longer, the detection signal with the first value; and responsive to detecting the write of the adjustment parameter, generate the detection signal with the second value that configures the parameter generation circuitry to resume generating at least one of the image data-conversion parameter and the backlight control parameter.

6. The display driver according to claim 5, wherein the parameter generation circuitry is further configured to:

during a dimming period, gradually change the image data-conversion parameter and the backlight control parameter in response to a change in at least one of the brightness distribution and the adjustment parameter, wherein the predefined period occurs after the dimming period has ended.

7. The display driver according to claim 1, wherein at least the parameter generation circuitry, the image data conversion circuitry, and the memory are formed on a common semiconductor substrate.

8. The display driver according to claim 1, wherein the detection circuitry is supplied with the received image data, wherein the parameter generation circuitry comprises:

data extraction circuitry configured to:

receive the image data received through the interface; and extract the brightness distribution of the frame of the image data;

and analysis/calculation circuitry operable to generate the image data-conversion parameter and the backlight control parameter based on the extracted brightness distribution, wherein the detection circuitry is further operable to detect whether the image data of the frame matches that of the preceding frame, and wherein the analysis/calculation circuitry is configured to generate at least one of the image data-conversion parameter and the backlight control parameter.

9. The display driver according to claim 8, wherein detecting whether the image data of the frame matches that of the preceding frame comprises:

applying a predetermined function to the image data of the frame to produce a first result;

applying the predetermined function to the image data of the preceding frame to produce a second result; and comparing the first result and the second result.

10. The display driver according to claim 9, wherein the predetermined function is a cyclic redundancy check.

11. The display driver according to claim 8, further comprising:

a register configured to store an adjustment parameter to be supplied to the parameter generation circuitry, wherein the detection circuitry is further configured to:

detect whether a write of the adjustment parameter to the register has occurred; and generate, responsive to determining that the write of the adjustment parameter has not occurred during a predefined period of one frame or longer, the detection signal with the first value.

12. The display driver according to claim 11, wherein the parameter generation circuitry is further configured to:

during a dimming period, gradually change the image data-conversion parameter and the backlight control parameter in response to a change in at least one of the brightness distribution and the adjustment parameter, wherein the predefined period occurs after the dimming period has ended.

13. The display driver according to claim 8, wherein the clock control circuitry is further configured to: stop supplying a third clock signal to the analysis/calculation circuitry in response to the detection signal.

14. The display driver according to claim 8, wherein at least the parameter generation circuitry and the image data conversion circuitry are formed on a common semiconductor substrate.

15. An apparatus comprising:

an interface operable to receive, from an external host processor, an image data write command and image data;

a memory configured to store a frame of the image data responsive to the image data write command;

parameter generation circuitry operable to generate an image data-conversion parameter based on a brightness distribution of the frame of the image data;

image data conversion circuitry operable to convert the image data based on the image data-conversion parameter;

source driver circuitry operable to drive source electrodes of a display with source signals that are based on the converted image data;

detection circuitry operable to:

detect whether the image data write command is received; and generate, responsive to detecting an absence of the image data write command, a detection signal with a first value indicating that there is no change between the frame and a preceding frame of the image data; and clock control circuitry configured to:

stop supplying a first clock signal to the parameter generation circuitry during a first period in response to the first value of the detection signal; and supply a second clock signal to backlight control circuitry during the first period, wherein the parameter generation circuitry is configured to stop generating the image data-conversion parameter responsive to the clock control circuitry stopping the supply of the first clock signal.

16. The apparatus according to claim 15, further comprising:

a register configured to store an adjustment parameter to supply to the parameter generation circuitry, wherein the detection circuitry is further configured to:

detect whether a write of the adjustment parameter to the register has occurred;

generate, responsive to determining that the write of the adjustment parameter has not occurred during a predefined period of one frame or longer, the detection signal with the first value; and generate, responsive to detecting one of the write of the adjustment parameter to the register and a presence of the image data write command, the detection signal with a second value that configures the parameter generation circuitry to resume generating the image data-conversion parameter.

17. The apparatus according to claim 15, further comprising:

a register configured to store an adjustment parameter to supply to the parameter generation circuitry, wherein the parameter generation circuitry comprises:

data extraction circuitry configured to:

receive the image data through the interface; and extract the brightness distribution of the frame of the image data;

and analysis/calculation circuitry operable to generate the image data-conversion parameter based on the extracted brightness distribution, and wherein the detection circuitry is further configured to determine whether the image data of the frame matches image data of the preceding frame.

18. The display driver of claim 5, wherein detecting whether the write of the adjustment parameter to the register has occurred comprises detecting one of:

a write command for the register, and a write enable signal for the register.

19. A method of operating a display driver, the method comprising:

receiving, from an external host processor, image data comprising a first frame;

responsive to an image data write command from the external host processor, storing the first frame in a memory of the display driver;

generating a conversion parameter based on a brightness distribution of the first frame;

converting the image data based on the conversion parameter;

driving source electrodes of a display with source signals based on the converted image data;

responsive to determining that the image data write command is not received within a predefined period of one frame or longer, generating a detection signal with a first value indicating that there is no change between the first frame and a subsequent second frame of the image data;

responsive to the first value of the detection signal, stopping supplying a first clock signal to parameter generation circuitry during a first period;

supplying, during the first period, a second clock signal to a blacklight control circuitry; and responsive to stopping supplying the first clock signal, transmitting a control signal to thereby stop generating the conversion parameter.

* * * * *